US008403240B2

(12) United States Patent
Chen

(10) Patent No.: US 8,403,240 B2
(45) Date of Patent: Mar. 26, 2013

(54) ROTARY WATERFALL SHOWER

(75) Inventor: Tianyu Chen, Xiamen (CN)

(73) Assignee: Xiamen Solex High-Tech Industries Co., Ltd., Xiamen (CA)

( * ) Notice: Subject to any disclaimer, the term of this patent is extended or adjusted under 35 U.S.C. 154(b) by 58 days.

(21) Appl. No.: 13/128,128

(22) PCT Filed: Jan. 12, 2010

(86) PCT No.: PCT/CN2010/070136

§ 371 (c)(1),
(2), (4) Date: May 6, 2011

(87) PCT Pub. No.: WO2010/081409

PCT Pub. Date: Jul. 22, 2010

(65) Prior Publication Data

US 2011/0210189 A1 Sep. 1, 2011

(30) Foreign Application Priority Data

Jan. 14, 2009 (CN) ..... 2009 1 0110910

(51) Int. Cl.

| | |
|---|---|
| ***B05B 3/04*** | (2006.01) |
| ***B05B 3/00*** | (2006.01) |
| ***B05B 1/18*** | (2006.01) |
| ***B05B 1/14*** | (2006.01) |

(52) U.S. Cl. ..... 239/240; 239/243; 239/381; 239/558; 239/559; 239/568

(58) Field of Classification Search ..... 239/225.1, 239/237, 240, 242, 243, 263.3, 380, 381, 239/556–559, 567, 568, 587.4, 597; 15/29
See application file for complete search history.

(56) References Cited

U.S. PATENT DOCUMENTS

| | | | | |
|---|---|---|---|---|
| 4,809,382 | A | 3/1989 | Ravn | |
| 5,385,532 | A * | 1/1995 | Shyu | 601/160 |
| 5,397,064 | A | 3/1995 | Heitzman | |
| 5,619,766 | A * | 4/1997 | Zhadanov et al. | 15/29 |
| 6,021,539 | A * | 2/2000 | Zhadanov et al. | 15/29 |
| 6,360,967 | B1 * | 3/2002 | Schorn | 239/240 |
| 2008/0083077 | A1 * | 4/2008 | Alexander et al. | 15/53.1 |
| 2008/0223957 | A1 * | 9/2008 | Schorn | 239/428.5 |

FOREIGN PATENT DOCUMENTS

| | | |
|---|---|---|
| CN | 101518759 | 9/2009 |
| CN | 201361587 | 12/2009 |

* cited by examiner

*Primary Examiner* — Darren W Gorman

(74) *Attorney, Agent, or Firm* — Rabin & Berdo, P.C.

(57) ABSTRACT

The invention discloses a rotary waterfall shower comprising a hollow body, transversely arranged vane wheels, a front cover arranged on the front end of the body in a sealing way and a water division member which is arranged in the body in a sealing way and can cause the vane wheels to rotate, a pinion wheel is fixedly arranged on the front end of the vane wheels in an axial direction and is meshed with output gear wheels distributed in a central symmetry way, and each output gear wheel can drive one rotary water discharge component arranged on the front end of the front cover to rotate horizontally. Water sprinkled out from the water outlet of the rotary waterfall shower can be dynamically rotated to form gainly clusters of spiral waterfall water blooms, and the shower has the effect of gentle massage.

8 Claims, 3 Drawing Sheets

ROTARY WATERFALL SHOWER

FIELD OF THE INVENTION

The present invention relates to a shower, especially to a rotary waterfall shower whose water outlet can rotate.

BACKGROUND OF THE INVENTION

In the conventional shower, its water outlet is generally designed with a plurality of water nozzles, said water nozzles can only applied for distributing the water outflow from the water outlets, when the user uses the conventional shower, the water will be sprinkled from the water nozzles and form a water column with great pressure, so the user may feel uncomfortable when the water column hits him. The user can only adjust the amount of the water outflow to reduce the pressure of the water column, however, the bath may not be quite effective since the amount of the water outflow is greatly reduced, therefore said conventional shower with single function can not satisfy the requirements of the consumer.

In order to overcome the above shortages, it needs to change the water output effects of the existing shower without reducing the amount of the water outflow, the water output effects are required to be flaky, waterfall-shaped, or even rotary, and the pressure of the water outflow sprinkled from the water outlets needs to be relatively gentle. Although shower with massage function have already been invented, it need to arrange an electric motor in the shower chamber in a sealing way, so it may be unsafe in the operation.

SUMMARY OF THE INVENTION

The object of the present invention is to provide a rotary waterfall shower with rotatable water outlet and overcome the shortages of the conventional technique. Water sprinkled out from the water outlet of the rotary waterfall shower can be dynamically rotated to form gainly clusters of spiral waterfall water blooms, and the shower has the effect of gentle massage.

The technical solution of the present invention is:

Rotary waterfall shower, comprising a hollow body, transversely arranged vane wheels, a front cover arranged on the front end of the body in a sealing way and a water division member which is arranged in the body in a sealing way and can cause the vane wheels to rotate, a pinion wheel is fixedly arranged on the front end of the vane wheels in an axial direction and is meshed with output gear wheels distributed in a central symmetry way, and each output gear wheel can drive one rotary water discharge component arranged on the front end of the front cover to rotate horizontally.

When the user uses the shower, the water flows into the oblique spray holes of the water division member, then strikes the vane wheels, the vane wheels is driven to rotate rapidly, therefore the pinion wheel on the front end of vane wheels is driven to rotate, then the output gear wheels are driven by the pinion wheel to rotate, finally the rotary water discharge components are driven by the respect output gear wheels to rotate.

The center hole of each output gear wheel is fixedly connected with the water discharge component in an axial direction. Alternatively, the vane wheels can also be arranged vertically, and then the water discharge components can be horizontally rotate in front of the front cover by the worm and gear. However, such structure is more complex, the shower may be easily broken during the operation.

Rotary shafts are respectively disposed on the two ends of the vane wheels, shaft seats are respectively disposed on the center of the water division member and the front cover and respectively matched with the water division member and the front cover, the vane wheels cooperate with the shaft seats on the water division member and the front cover by its rotary shafts and set up between the water division member and the front cover.

The water discharge component comprises a front end cover, a rear end cover fixed and pivoted with said front end cover, two water adjusting plates and a post rod; the two water adjusting plates are oppositely disposed between the front end cover and the rear end cover, said post rod is integrated on the rear end of the rear end cover; the top portion of the outside of the post rod forms a cylindrical spacing member, the center hole of the output gear wheel is a stepped hole, a small hole of said stepped hole is tightly matched with the outer wall of the spacing member; rotary shafts with the same number as the output gear wheels are fixedly disposed on the front end of the water division member, said spacing member sleeves and clearance fit with said rotary shafts, such that the water discharge components can be driven by respective output gear wheels and rotate round said rotary shafts.

A water nozzle is disposed on the lower position of the spacing member, the water nozzle extends to the bottom of the post rod from the wall of said post rod, and passes through the rear end cover, said two water adjusting plates are oppositely fixed on the inside of the rear end cover and corresponds to the lower position of the outlet of said water nozzle, and a filtering film is fixed on the front of the water output end of said water nozzle, stripped water outlets are respectively fixed on the front end cover of each water discharge component, the shape of the stripped water outlet is adapted to the shape of water adjusting member.

At least one oblique spray hole is disposed on its side wall. For example, at least two oblique spray holes are both clockwisely or anti-clockwisely disposed on the water division member sideways, the distribution of the water output end of the spray holes adapts the vane wheels, so as to drive the vane wheels rotate; alternatively, one oblique spray hole is disposed on the water division member sideways, the distribution of water output end of said oblique spray hole adapts the vane wheels.

There are interval pillars disposed oppositely on the front end of the output gear wheels and correspond to the periphery of the center hole, so the water can flow into the water nozzle of the water discharge components through the intervals between the pillars, thus better washing effects are achieved.

The water division member is fixed in the body after being spaced by a sealing ring, the front cover is fixed on the front of the body after being spaced by another sealing ring.

The diameter of the output gear wheel is greater than the diameter of pinion wheel fixedly disposed on the front end of the vane wheels, so that the rotating speed of the water discharge component can be reduced.

The number of said output gear wheels is 2~8.

Unless otherwise specified, the meanings of the scientific and technical terms in the present invention are similar to knowledge of those ordinary skilled in the art. Similarly, publications, patent applications and granted patents mentioned in the present invention can be used as references to the present invention.

The "front end" and the "rear end" mentioned in the present invention are set according to the direction when the shower is operated, that is the water output end of the shower is the "front end", the water inlet end of the shower is the "rear end".

Moreover, "transversely arranged" means the arrange direction is parallel to the water output end surface.

Conferred from the above description, the present invention provides a rotary waterfall shower with simple structure, the present rotary waterfall shower applies the impact force of the water stream to drive the vane wheels and the pinion wheel under the vane wheels rotate, then the output gear wheels meshed with the pinion wheel is driven to rotate, then the output gear wheels drive the pivoted water discharge components drive; meanwhile, the water stream flows into the inner chamber of the water division member from the oblique spray holes of the water division member, then flows into the water discharge components from the intervals of the pillars, finally the water will rotatably sprinkled out from the stripped water outlets after being adjusted by the water adjusting plate along with the rotation of the water discharge components, so the rotary waterfall shower can be dynamically rotated to form gainly clusters of spiral waterfall water blooms.

Figure 1:
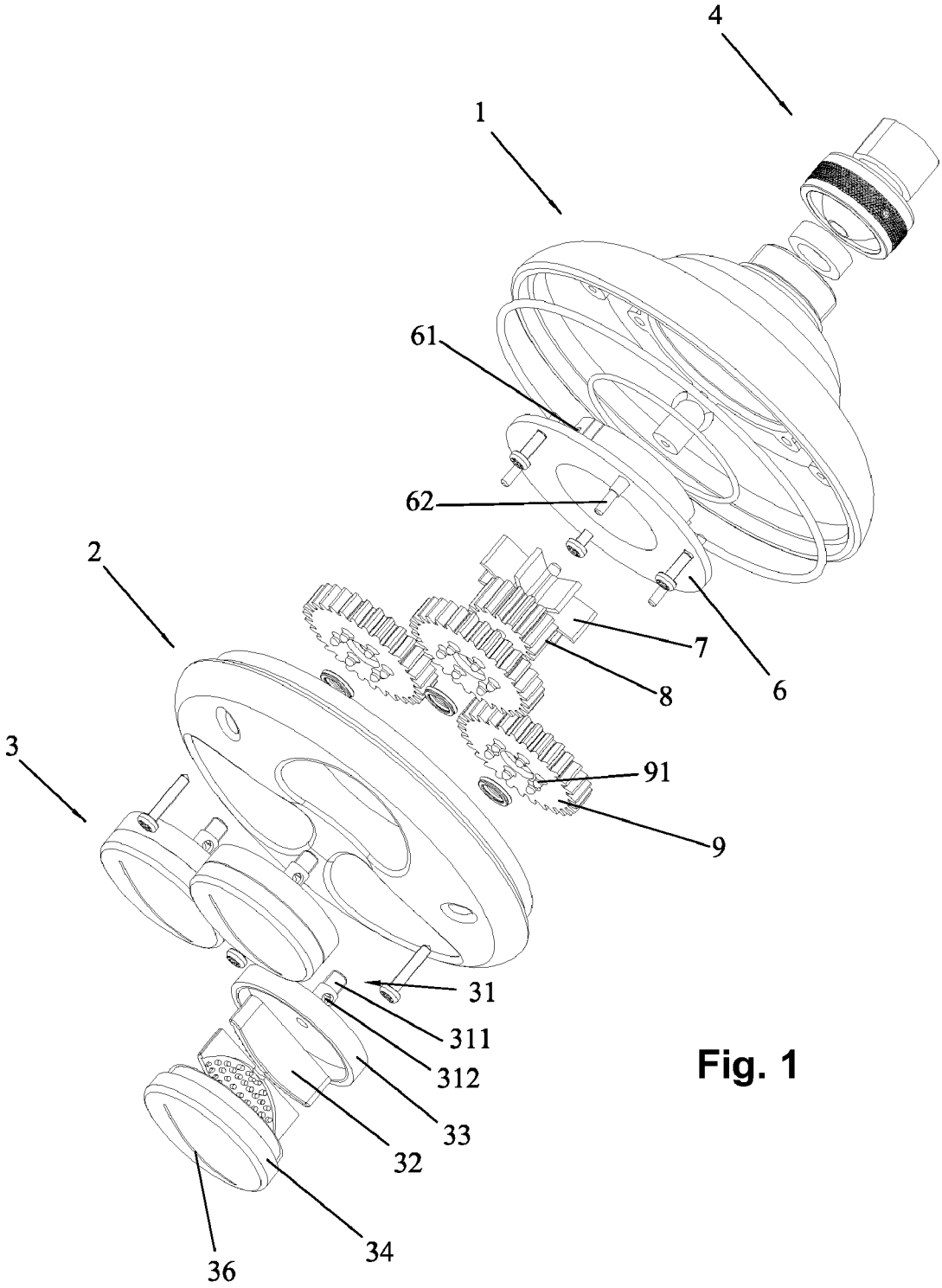
FIG. 1 is the perspective and exploded view of the shower.
Figure 2:
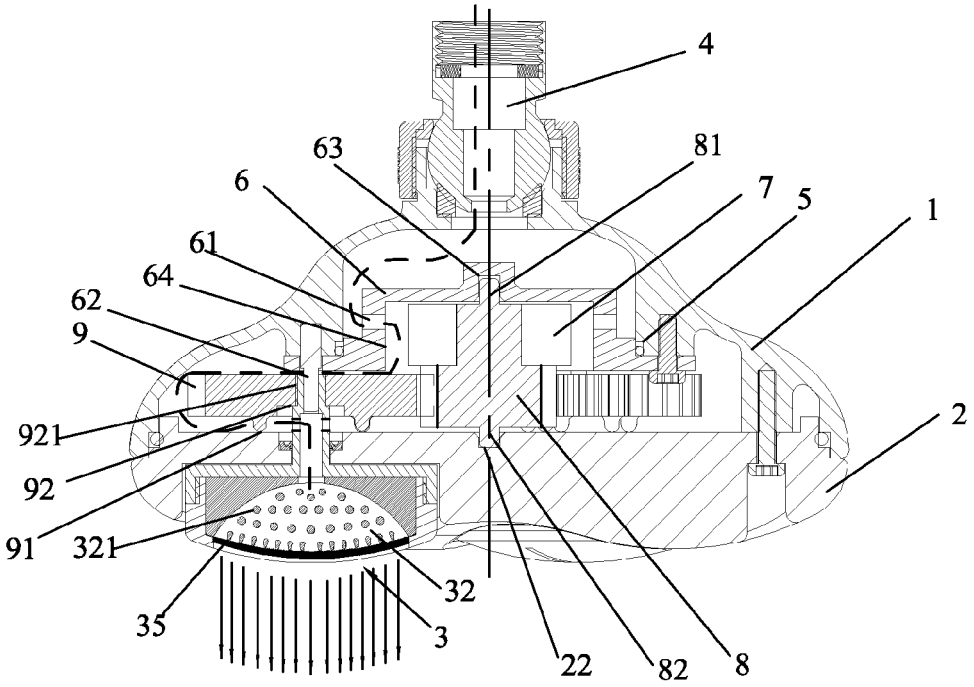
FIG. 2 is the sectional view of the shower.
Figure 3:
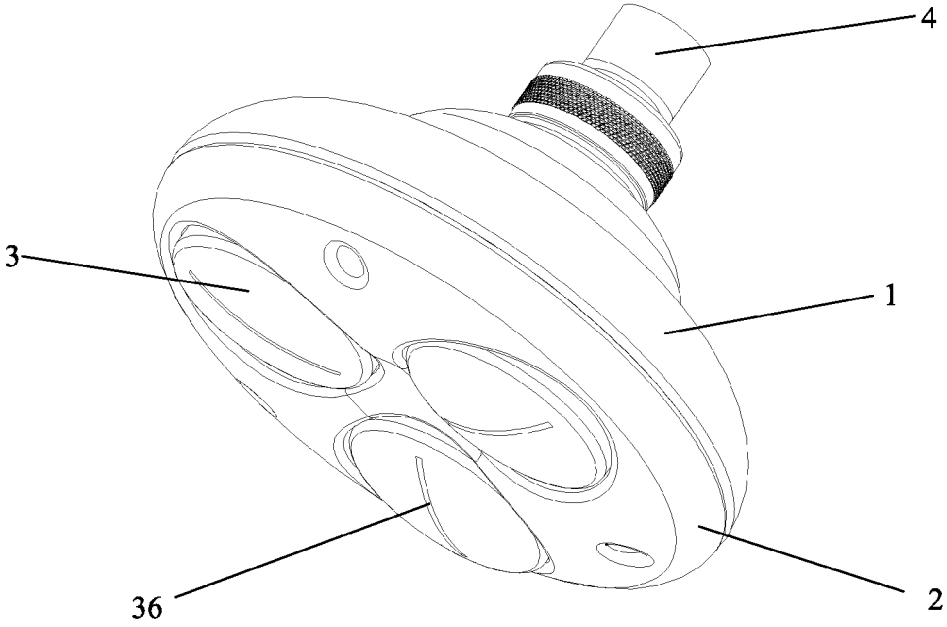
FIG. 3 is the perspective structural view of the shower.
Figure 4:
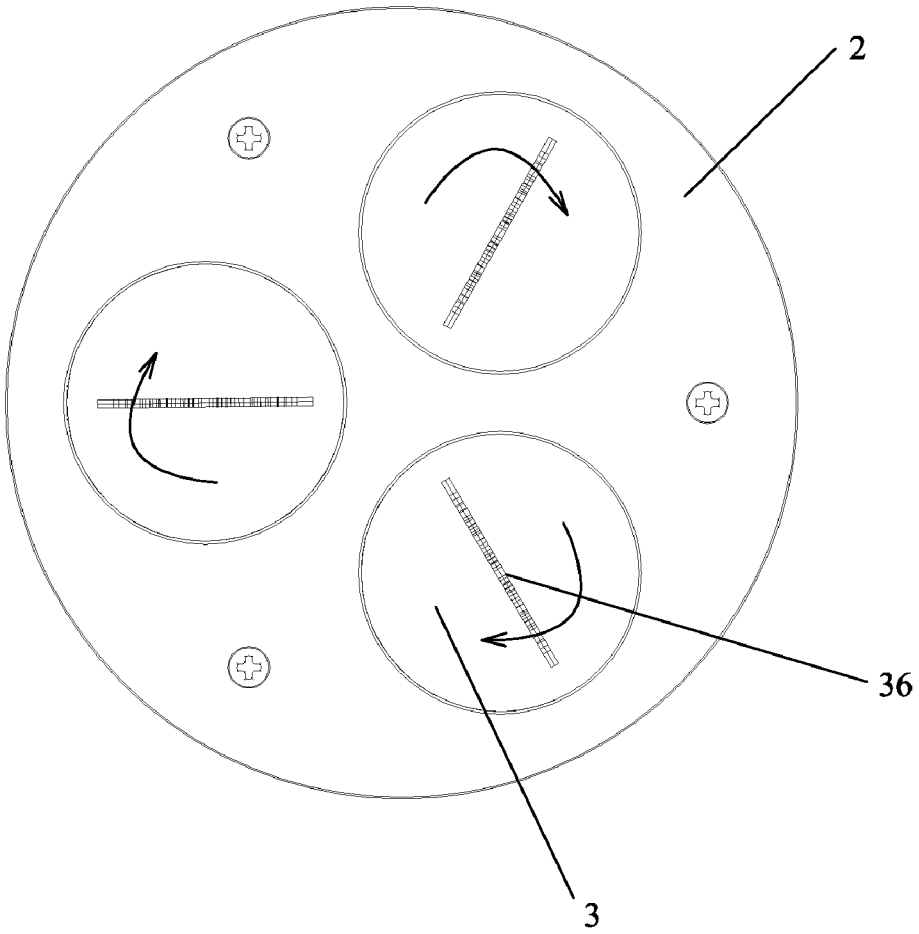
FIG. 4 is the operation status of the shower.

Diagram legend: body 1, front cover 2, water discharge component 3, joint head 4, water division member 6, vane wheel 7, pinion wheel 8, output gear wheel 9, post rod 31, spacing member 311, water nozzle 312, water adjusting plate 32, rear end cover 33, front end cover 34, filtering film 35, stripped water outlet 36, rotary shaft 51, oblique spray hole 61, pillar 91.

DETAILED DESCRIPTION OF THE EMBODIMENTS

Embodiment 1

The present invention will become clear with the reference of the detailed description of the embodiments and the accompanying drawings.

The rotary waterfall shower, comprising a hollow body 1, a front cover 2, water discharge components 3, a joint head 4, a water division member 6, a vane wheel (impeller) 7, a pinion wheel 8 and output gear wheels 9. The front cover 2 is fixed on the front of the body 1 after being spaced by a sealing ring. The water division member 6 with an oblique spray hole 61 is fixed in the body 1 after being space by a sealing ring 5. The pinion wheel 8 is fixedly arranged on the front end of the vane wheel 7 in an axial direction. Two rotary shafts 81 and 82 are disposed on the two ends of the vane wheel 7, shaft seats 63, 22 are respectively disposed on the center of the water division member 6 and the front cover 2 and respectively matched with the water division member 6 and the front cover 2. The vane wheel 7 cooperates with the shaft seats 6, 22 on the water division member 6 and the front cover 2 by its rotary shafts 81,82 and is set up between the water division member 6 and the from cover 2. The water division member 6 is a sleeving cover, which defines a vane wheel containing space 64. There are two oblique spray holes 61 horizontally and sideways disposed on the side wall of the water division member 6 in a same direction. The water output end of the oblique spray holes 61 are adapted to the vane wheel 7 and drives the vane wheel 7 to rotate.

The pinion wheel 8 is meshed with three output gear wheels 9 distributed in a central symmetry way, and the center hole 92 of each output gear wheel 9 is fixedly pivoted with a water discharge component 3 in an axial direction.

Each water discharge component 3 comprises a front end cover 34, a rear end cover 33 fixed and pivoted with said front end cover 34, two water adjusting plates 32 and a post rod 31; there are five rows of protrusions 321 disposed on the inner surface of said two water adjusting plates 32. The number of protrusions 321 increases from row to row. The protrusions are distributed semi-circularly, the two water adjusting plates 32 are oppositely disposed between the front end cover 34 and the rear end cover 33. The post rod 31 is integrated on the rear end of the rear end cover 33. The top portion of the outside of the post rod 31 forms a cylindrical spacing member 311. The center hole 92 of the output gear wheel 9 is a stepped hole. A small hole 921 of said stepped hole is tightly matched with the spacing member 311 (by means of screw, welding and so on). Meanwhile there are three rotary shafts 6 fixedly disposed on front end of the water division member 6, said spacing member 311 of the post rod 31 sleeves and clearance fit with said rotary shafts 62; that is: the outer wall of the spacing member 311 is tightly matched with the small hole 921 of the center hole 92 of the output gear wheel 9, and the inner hole of the spacing member 311 of the post rod 31 is clearance fit with the rotary shaft 62 of the water division member 6, such that the water discharge components 3 can be driven by said output gear wheels 9 and rotate round said rotary shafts 62. The diameter of each output gear wheel 9 is greater than the diameter of the pinion wheel 8 of front end of the vane wheel 7, so as to reduce the rotating speed of the water discharge components 3.

There are interval pillars 91 disposed oppositely on the front end of the output gear wheels 9 and correspond to the periphery of the center hole. A water nozzle 312 is disposed on the lower position of the spacing member 311. The water nozzle 312 extends to the bottom of the post rod 31 from the wall of said post rod 31, and passes through the rear end cover 33. The water stream can flow into the water nozzle 312 of the water discharge components 3 from the intervals of the pillars 91. The height of the pillar 91 is adapted to the disposition the water inlet end of the water nozzle 312. The two water adjusting plates 32 are oppositely fixed on the inside of the rear end cover 33 and correspond to the lower position of said water nozzle 312, and a filtering film 35 is fixed on the front of the water outlet end. A stripped water outlet 36 is fixed on the front end cover 34 of the water discharge component 3 whose shape is adapted to the shape of water adjusting member 32. The water adjusting member 32 will unify the distribution of the water stream the water discharge component 3 by its protrusions 321, and then the unified water stream will flow out of the stripped water outlet 36 through the filtering film 35.

When the user uses the shower, firstly the water stream flows into the oblique spray holes 61 of the water division member 6 after flowing from the joint head 4, then the water stream strikes the vane wheel 7 and the vane wheel rotates rapidly, thus the pinion wheel 8 of front end of the vane wheel 7 is driven to rotate, and the output gear wheels 9 meshed with the pinion wheel 8 are driven to rotate, so the water discharge component 3 is driven by the output gear wheels 9 to rotate; meanwhile, the water stream will flow into the inner chamber of the water division member 6 from the oblique spray holes 61 of the water division component 6, then flows into the water nozzle 312 of the post rod 31 from the intervals of the pillars 91, and flows out of the stripped water outlets 36 after passing through the water adjusting plates 32 and the filtering film 35, so the rotary waterfall shower can form three gainly clusters of spiral waterfall water blooms.

Although the present invention has been described with reference to the preferred embodiments thereof for carrying out the invention, it is apparent to those skilled in the art that a variety of modifications and changes may be made without departing from the scope of the present invention which is intended to be defined by the appended claims.

INDUSTRIAL APPLICABILITY

The present invention provides a rotary waterfall shower with simple structure, it is skillfully constructed, the present rotary waterfall shower applies the impact force of the water stream to drive the vane wheels rotate, further drive the water discharge components rotate, so the water will rotatably sprinkled out from the stripped water outlets after being adjusted by the water adjusting plates, therefore the rotary waterfall shower can be dynamically rotated to form several gainly clusters of spiral waterfall water blooms, it has a good industrial applicability.

What is claimed is:

1. A rotary waterfall shower, comprising;

a hollow body;

a transversely arranged impeller having rotary shafts disposed on opposite ends thereof;

a front cover arranged on a front end of the body in a sealing manner, and having a first shaft seat disposed in a center thereof;

a plurality of rotary water discharge components arranged on a front end of the front cover, each water discharge component comprising:

a front end cover;

a rear end cover fixed and pivoted with the front end cover;

two water adjusting plates oppositely disposed between the front end cover and the rear end cover; and a post rod integrated on a rear end of the rear end cover, a top portion of an outside of the post rod forming a cylindrical spacing member;

a water division member arranged in the body in a sealing manner and causing the impeller to rotate, and having a second shaft seat disposed in a center thereof, one of the rotary shafts of the impeller being received within the second shaft seat of the water division member and another one of the rotary shafts of the impeller being received within the first shaft seat of the front cover so that the impeller is disposed between the water division member and the front cover, said water division member haying a plurality of rotary shafts disposed on a front end thereof, each cylindrical spacing member being sleeved in a clearance fit with a respective rotary shaft of said water division member;

a plurality of output gear wheels equal in number to a number of the rotary shafts of the water division member, and distributed in a central symmetrical manner, each output gear wheel having a stepped center hole fixedly connected with a respective water discharge component in an axial direction by tightly matching an outer wall of a respective cylindrical spacing member with a small hole of the stepped center hole, with each output gear wheel driving one respective rotary water discharge component to rotate horizontally around a respective rotary shaft of the water division member; and a pinion wheel fixedly arranged on a front end of the impeller in the axial direction and being meshed with the output gear wheels.

2. The rotary waterfull shower according to claim 1, wherein each post rod has a water nozzle is disposed on a lower position of the spacing member, the water nozzle extending to a bottom of the post rod from a wall of said post rod, and passing through the rear end cover, said two water adjusting plates being oppositely disposed on an inside of the rear end cover and corresponding to a lower position of an outlet of said water nozzle, a filtering film being disposed in front of the outlet of said water nozzle, a stripped water outlet being respectively disposed on the front end cover of each water discharge component.

3. The rotary waterfall shower according to claim 1, an inner surface of each of said two water adjusting plates has rows of protrusions disposed thereon, a number of the protrusions increasing from row to row, said protrusions being distributed semi-circularly.

4. The rotary waterfall shower according to claim 2, wherein said water division member is a sleeving cover, which defines an impeller containing space, at least one oblique spray hole being disposed on a side wall of said water division member, with water being sprayed from the oblique spray hole to directly drive the impeller to rotate.

5. The rotary waterfall shower according to claim 2, wherein each output gear wheel has a plurality of interval pillars disposed on a front end thereof and disposed around a periphery of the stepped center hole.

6. The rotary waterfall shower according to claim 4, further comprising a first sealing ring disposed between the water division member and the body, and a second sealing ring disposed between the front cover and the front end of the body.

7. The rotary waterfall shower according to claim 4, wherein a number of said output gear wheels is 2-8, and a number of the water discharge components corresponds to the number of output gear wheels.

8. The rotary waterfall shower according to claim 3 wherein each output gear wheel has a plurality of interval pillars disposed on a front end thereof and disposed around a periphery of the stepped center hole.

* * * * *